US009410398B2

(12) United States Patent
O'Malley et al.

(10) Patent No.: US 9,410,398 B2
(45) Date of Patent: Aug. 9, 2016

(54) DOWNHOLE SYSTEM HAVING COMPRESSABLE AND EXPANDABLE MEMBER TO COVER PORT AND METHOD OF DISPLACING CEMENT USING MEMBER

(71) Applicants: Edward J. O'Malley, Houston, TX (US); James G King, Kingwood, TX (US); Charles C. Johnson, League City, TX (US)

(72) Inventors: Edward J. O'Malley, Houston, TX (US); James G King, Kingwood, TX (US); Charles C. Johnson, League City, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 263 days.

(21) Appl. No.: 14/039,459

(22) Filed: Sep. 27, 2013

(65) Prior Publication Data

US 2015/0090448 A1 Apr. 2, 2015

(51) Int. Cl.

| | |
|---|---|
| ***E21B 43/28*** | (2006.01) |
| ***E21B 34/06*** | (2006.01) |
| ***E21B 43/114*** | (2006.01) |
| ***E21B 43/26*** | (2006.01) |
| *E21B 34/00* | (2006.01) |

(52) U.S. Cl.

CPC ..... *E21B 34/063* (2013.01); *E21B 43/114* (2013.01); *E21B 43/26* (2013.01); *E21B 2034/007* (2013.01)

(58) Field of Classification Search

CPC ..... E21B 23/00; E21B 23/06; E21B 33/1208; E21B 43/28

See application file for complete search history.

(56) References Cited

U.S. PATENT DOCUMENTS

| | | | | |
|---|---|---|---|---|
| 3,273,641 | A | 9/1966 | Bourne | |
| 5,094,103 | A | 3/1992 | Wicks, III | |
| 5,515,915 | A | 5/1996 | Jones et al. | |
| 6,619,398 | B2 | 9/2003 | MacKenzie et al. | |
| 6,662,873 | B1 | 12/2003 | Nguyen et al. | |
| 6,755,249 | B2 | 6/2004 | Robison et al. | |
| 6,834,725 | B2 | 12/2004 | Whanger et al. | |
| 7,243,732 | B2 | 7/2007 | Richard | |
| 7,318,481 | B2 | 1/2008 | Richard | |
| 7,392,852 | B2 | 7/2008 | Richard | |
| 7,578,347 | B2 | 8/2009 | Bosma | |
| 7,690,437 | B2 * | 4/2010 | Guillot et al. | 166/387 |
| 7,784,532 | B2 | 8/2010 | Sevre et al. | |
| 7,866,393 | B2 | 1/2011 | Badalamenti et al. | |

(Continued)

FOREIGN PATENT DOCUMENTS

| | | | |
|---|---|---|---|
| AU | 2011218707 | A1 | 9/2011 |
| WO | 2011131306 | A1 | 10/2011 |

(Continued)

OTHER PUBLICATIONS

"FracPoint MP Sleeve with DirectConnect Ports"; Baker Hughes Incorporated; Trade Show Material, 2012; 4 pages.

(Continued)

*Primary Examiner* — Catherine Loikith
(74) *Attorney, Agent, or Firm* — Cantor Colburn LLP

(57) ABSTRACT

A downhole system including a tubular having a wall with at least one port there through. At least one member arranged to cover the at least one port in a compressed condition thereof. Configured to at least partially displace cement pumped on an exterior of the tubular in a radially expanded condition of the at least one member. Also included is a method of non-ballistically opening ports in a tubular of a downhole system.

18 Claims, 4 Drawing Sheets

(56) References Cited

U.S. PATENT DOCUMENTS

| | | | | |
|---|---|---|---|---|
| 8,104,538 | B2 * | 1/2012 | Richard et al. | 166/308.1 |
| 8,967,276 | B2 | 3/2015 | Mazyar et al. | |
| 2003/0070811 | A1 | 4/2003 | Robison et al. | |
| 2004/0168804 | A1 | 9/2004 | Reddy | |
| 2005/0205263 | A1 | 9/2005 | Richard | |
| 2006/0124310 | A1 | 6/2006 | Lopez De Cardenas et al. | |
| 2006/0207765 | A1 | 9/2006 | Hofman et al. | |
| 2008/0210423 | A1 | 9/2008 | Boney | |
| 2008/0289823 | A1 | 11/2008 | Willberg et al. | |
| 2009/0188569 | A1 | 7/2009 | Saltel | |
| 2010/0096119 | A1 | 4/2010 | Sevre et al. | |
| 2010/0230103 | A1 | 9/2010 | Parker | |
| 2010/0300689 | A1 | 12/2010 | McRobb et al. | |
| 2010/0314111 | A1 | 12/2010 | Karcher | |
| 2011/0077324 | A1 | 3/2011 | Ravi | |
| 2011/0135953 | A1 | 6/2011 | Xu | |
| 2011/0220359 | A1 | 9/2011 | Soliman et al. | |
| 2011/0220362 | A1 | 9/2011 | Huang | |
| 2011/0226479 | A1 | 9/2011 | Tippel et al. | |
| 2011/0284229 | A1 | 11/2011 | Radmanovich et al. | |
| 2012/0175134 | A1 | 7/2012 | Robisson et al. | |
| 2012/0261127 | A1 | 10/2012 | Zhou | |
| 2013/0140043 | A1 | 6/2013 | Swanson et al. | |
| 2013/0180725 | A1 | 7/2013 | Richard et al. | |
| 2013/0199843 | A1 | 8/2013 | Ross | |
| 2014/0110119 | A1 | 4/2014 | Luyster et al. | |
| 2015/0027709 | A1 | 1/2015 | Richard et al. | |
| 2015/0090449 | A1 | 4/2015 | O'Malley et al. | |

FOREIGN PATENT DOCUMENTS

| | | | |
|---|---|---|---|
| WO | 2011131307 | A1 | 10/2011 |
| WO | 2013109408 | A1 | 7/2013 |

OTHER PUBLICATIONS

A.S. Metcalf et al., "Case Histories of Successful Acid Stimulation of Carbonate Completed With Horizontal Open Hole Wellbores"; Journal of Canadian Petroleum Technology, vol. 48, No. 6; Jun. 2006, 5 pages.

Brooks et al. "Use of Swellable Elastomers to Enhance Cementation in Deep Water Applications" Deep Offshore Technology Conference—International in Houston, TX, Feb. 12-14, 2008, pp. 13.

International Search Report and the Written Opinion of the International Searching Authority; PCT/US2014/044505; Oct. 27, 2014, 5 pages.

International Search Report and the Written Opinion of the International Searching Authority; PCT/US2014/050635; Mailed Nov. 28, 2014; 13 pages.

Miller et al., Unlocking Tight Oil: Selective Multi-Stage Fracturing in the BakkenShale, Whiting Petroleum Corporation, Baker Hughes, Sep. 21-24, 2008, SPE International 116105-MS, pp. 1-6.

Notification of Transmittal of the International Search Report and Written Opinion of the International Searching Authority, or the Declaration; PCT/US2013/020049; Apr. 10, 2013, 9 pages.

PCT International Search Report and the Written Opinion of the International Searching Authority; PCT/US2014/050638; Nov. 21, 2014, 15 pages.

* cited by examiner

DOWNHOLE SYSTEM HAVING COMPRESSABLE AND EXPANDABLE MEMBER TO COVER PORT AND METHOD OF DISPLACING CEMENT USING MEMBER

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. A tubular inserted within the borehole is used for allowing the natural resources to flow within the tubular to a surface or other location, or alternatively to inject fluids from the surface to the borehole. Opening perforations through the wall of the tubular to allow fluid flow there through after deployment of the tubular within the borehole is not uncommon. One method of opening such perforations is through ignition of ballistic devices, referred to as perforation guns. Due to the explosive nature of the guns, the art would be receptive to alternate methods of opening perforations in tubulars that do not require guns.

SUMMARY

A downhole system includes a tubular having a wall with at least one port there through; and at least one member arranged to cover the at least one port in a compressed condition thereof, and configured to at least partially displace cement pumped on an exterior of the tubular in a radially expanded condition of the at least one member.

A method of non-ballistically opening ports in a tubular of a downhole system, the method includes covering at least one port in the tubular with an initially compressed radially extendable member; inserting the tubular within a borehole; cementing an annular space between the tubular and the borehole; allowing the radially extendable member to expand from heat of curing cement; and, at least partially displacing the cement with the radially extendable member.

BRIEF DESCRIPTION OF THE DRAWINGS

Referring now to the drawings wherein like elements are numbered alike in the several Figures.

DETAILED DESCRIPTION

Figure 1:
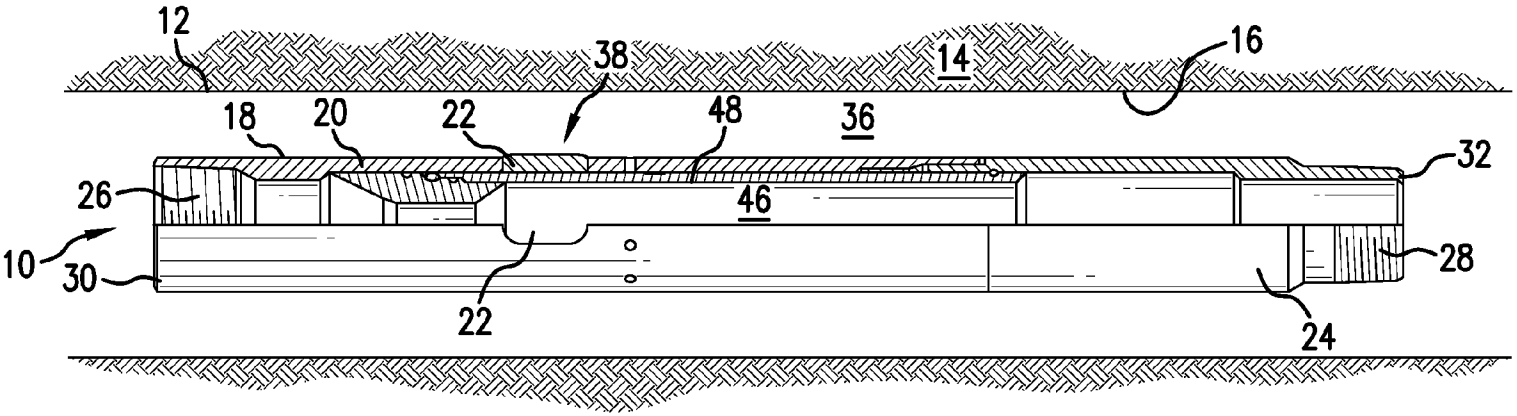
FIG. 1 is a partial quarter cross-sectional view of an exemplary embodiment of a downhole system with a radially extendable member in a non-extended condition.

A detailed description of one or more embodiments of the disclosed apparatus and method are presented herein by way of exemplification and not limitation with reference to the Figures.

Referring to FIGS. 1-6, an exemplary embodiment of a downhole system 10 is illustrated. The system 10 is a non-ballistic tubular perforating system employable as a completion system within a borehole 12 extending through a formation 14. The borehole 12 has a wall 16 that may be fractured to enhance the extraction of natural resources from the formation 14. The system 10 includes a tubular 18 having a wall 20 with flow ports 22 there through. While only one section 24 of the tubular 18 is illustrated, it should be understood that several zones within the borehole 12 may be operated thereon using the system 10 by connecting the section 24 of the tubular 18 to other sections 24, such as by using the threaded connections 26, 28 shown at the uphole and downhole ends 30, 32, respectively, of the section 24, or by connecting the section 24 to other sections 24 with other pieces of tubular (not shown) positioned there between. Cement 34 (shown in FIGS. 2-6 only) is positionable radially of the tubular 18 in an annular space 36 between the wall 20 of the tubular 18 and the wall 16 of the borehole 12, as will be further described below. At least one radially extendable member 38 is positioned radially outwardly of the tubular 18 in locations covering the ports 22. As illustrated, the ports 22 are elongated apertures in the wall 20 that that are radially distributed about the tubular 18, although other shapes and arrangements of the ports 22 may also be included in the system 10. For operating within different longitudinally spaced zones of the borehole 12, longitudinally spaced ports 22 can be provided, such as by the interconnection of two or more of the sections 24 of the tubular 18. The member 38 can be provided at discrete locations to block each individual port 22, or a single member can wrap around the outer periphery of the tubular 18 to cover several ports 22, such as all the ports 22 within a particular section 24 of the tubular 18. The members 38 may be provided entirely or partially within each port 22, or radially exteriorly of the ports 22. The members 38 are configured to cover the peripheries of their associated ports 22.

The radially extendable member 38 is a foamed shape memory polymer ("SMP") that can increase radially while surrounding the ports 22 of the tubular 18. The system 10 employs foamed shape memory polymer, such as, but not limited to, Morphic™ technology, a shape memory polymeric open-cell foam available from Baker Hughes, Inc., as a volumetric masking agent to limit the amount and quality of cement 34 delivered to certain areas within the borehole 12.

With reference to FIG. 1, the members 38 are initially provided in a compressed state on the outer diameter of the tubular 18. The members 38 are mounted on the outer diameter, or within the ports 22, in such a way that they surround, enclose, or fill at least the perimeter and area of the flow ports 22. The members 38 are engineered such that they will remain compacted during deployment of the system 10. FIG. 1 shows the system 10 with the members 38 in the compressed state while being run in the borehole 12. The members 38 will deploy to the uncompacted shape substantially surrounding/enclosing the flow ports 22 of the system 10 upon exposure to heat (such as that generated by curing cement 34, or by a chemical reaction between a material in or around the members 38 with a fluid circulated in front of the cement 34).

Figure 2:
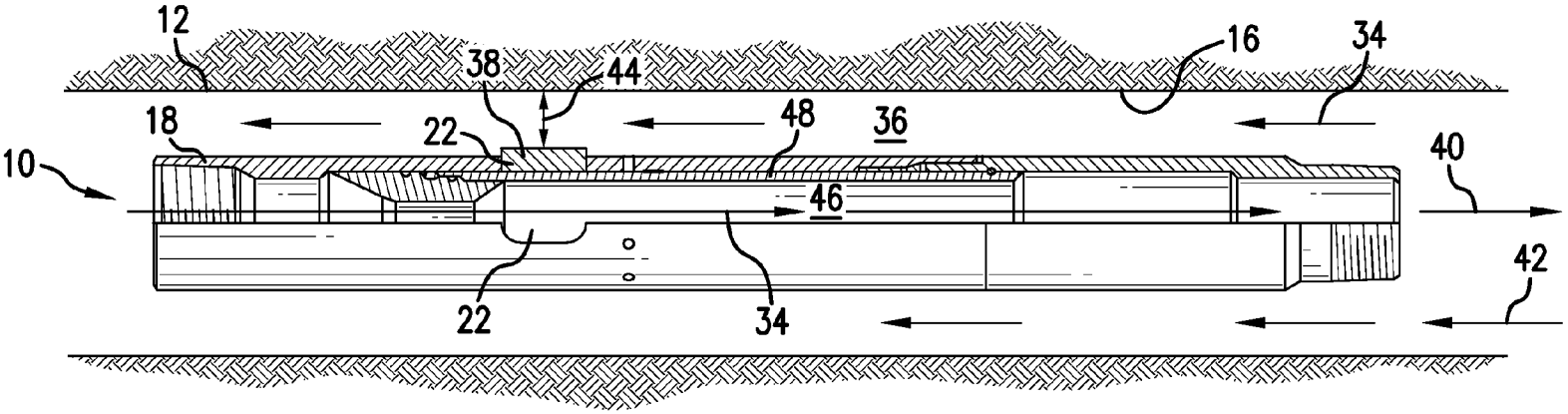
FIG. 2 is a partial quarter cross-sectional view of the downhole system of FIG. 1 depicting a cementing operation.
Figure 3:
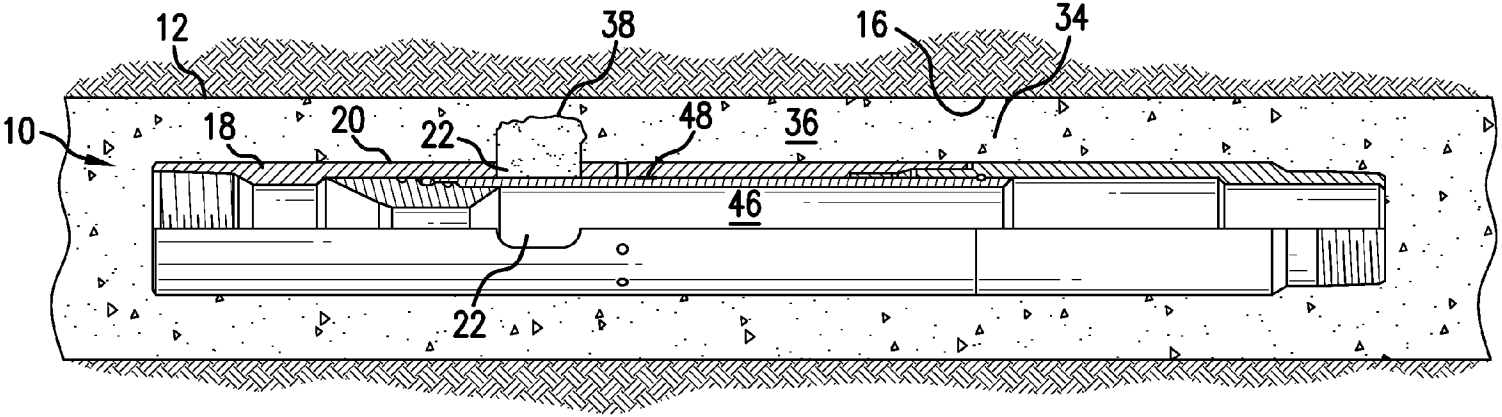
FIG. 3 is a partial quarter cross-sectional view of the downhole system of FIG. 1 with the radially extendable member in a partially extended condition.
Figure 4:
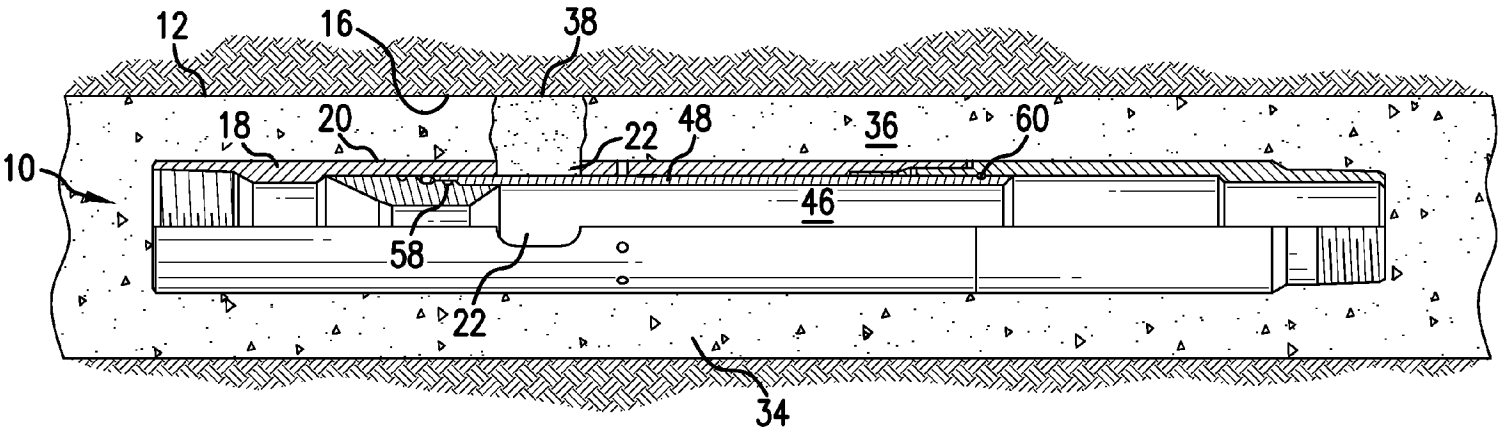
FIG. 4 is a partial quarter cross-sectional view of the downhole system of FIG. 1 with the radially extendable member in a fully extended condition.

The introduction of cement 34 is shown in FIG. 2. The cement 34 is pumped in a downhole direction 40 through the tubular 18. At an end of the tubular 18 (not shown), after the cement 34 escapes the tubular 18, the cement 34 moves in an uphole direction 42 through the annular space 36 between the tubular 18 and the borehole wall 16. Radially extending the radially extendable member 38 after the cement 34 is pumped allows the cement 34 to be pumped through the annular clearance 44 between the wall 16 of the borehole 12 and the radially extendable member 38. After-which radially extending of the radially extendable member 38 displaces some more of the cement 34 as the radially extendable member 38 radially extends into contact with the wall 16. The members 38 will deploy to the un-compacted shape substantially surrounding/enclosing the flow ports 22 of the system 10 upon exposure to heat (such as that generated by curing cement 34). This is shown in FIG. 3, with the members 38 being deployed and displacing the green cement 34 (cement 34 that has not yet cured). The expanding foam of the members 38 will extend from the outer diameter of the tubular 18 out to the inner diameter of the borehole wall 16, and contact and conform to this wall 16, as shown in FIG. 4. The porosity and stiffness of the foam of the members 18 is engineered so that as the foam expands it displaces uncured cement 34 from the area into which it deploys. The displacement of the uncured cement 34 may be complete, or may include only enough liquid and particulate to severely degrade the quality of any cement 34 remaining in the area once cured. If necessary the cement may be retarded somewhat to align cure rate with foam deployment. The radially extendable member 38 establishes essentially a cement free pathway from the interior 46 of the tubular 18 through the ports 22 and through the radially extendable member 38 to the earth formation 14.

Figure 5:
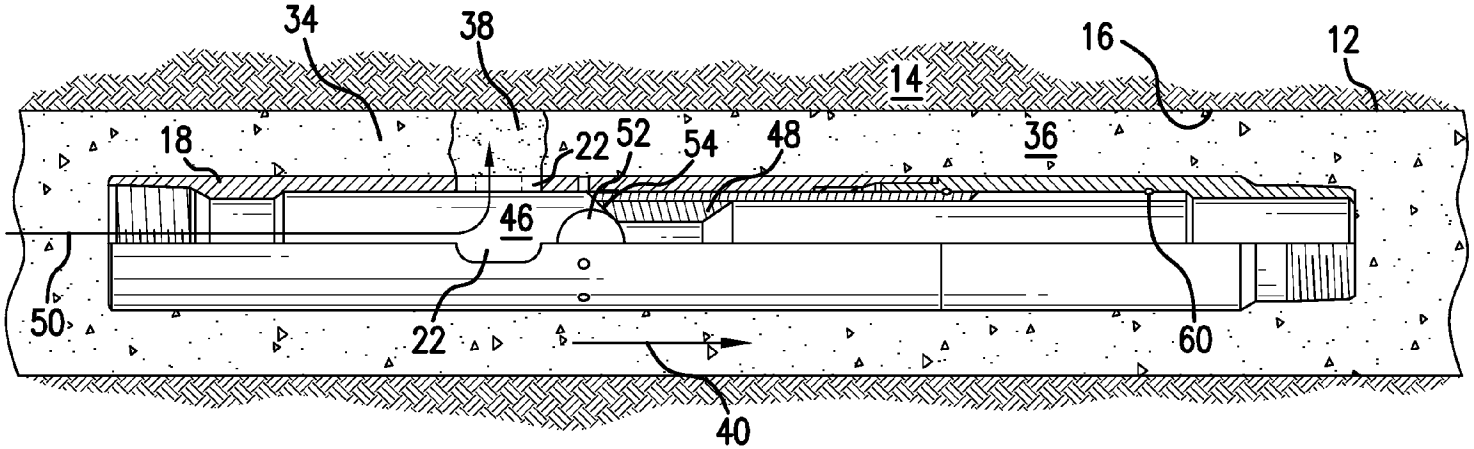
FIG. 5 is a partial quarter cross-sectional view of the downhole system of FIG. 1 with a sleeve shifted and a foam attacking agent introduced.

Once the cement 34 has at least substantially cured in the unmasked areas (the areas not containing the deployed members 38), the system 10 is activated to move sleeves 48 and expose the ports 22 through a series of ball drops. As shown in FIG. 5, after cement 34 has cured, fracturing operations can begin from the pressure activated toe-sleeve by pressuring up the system 10 to open the sleeve 48, and pumping an agent 50 that attacks the shape memory polymer foam in the area surrounding the outer diameter of the now-open pressure activated sleeve 48. FIG. 5 demonstrates one exemplary embodiment for opening the sleeve 48, which includes the landing of a plug, such as a ball 52, on a ball seat 54. Seating the ball 52 allows pressure built against the ball 52 to move the ball 52, ball seat 54 and attached sliding sleeve 48 in a downhole direction 40. Movement of the sliding sleeve 48 in the downhole direction 40 reveals the ports 22 and the deployed member 38, which are otherwise sealed from the interior 46 of the tubular 18 via seals 58, 60 that seal the sleeve 48 relative to the wall 20 of the tubular 18. That is, once the sliding sleeve 48 is moved, the interior 46 of the tubular 18 is fluidically connected to the ports 22 and deployed member 38. The sliding sleeve 48 may include ports (not shown) that are misaligned with ports 22 in the tubular 18 in a non-activated condition of the sleeve 48, and aligned with the ports 22 in the tubular 18 when the sliding sleeve 48 is moved into an open condition of the ports 22. Alternatively, the sliding sleeve 48 may be imperforate and moved completely away from the ports 22 in the tubular 18 to provide direct access between the interior 46 of the tubular 18 and the members 38. Agent 50, which may attack or remove the member 38, and may include a solvent, such as but not limited to dimethylformamide and ethylene glycol monobutyl ether, may be pumped at the lead of each stage intended to undermine the strength of the member 38. Treating the members 38 with the agent 50 has the effect of maximizing the area available to flow for fracturing treatment and limiting tortuosity, while maintaining the integrity advantages of a cemented liner.

Figure 6:
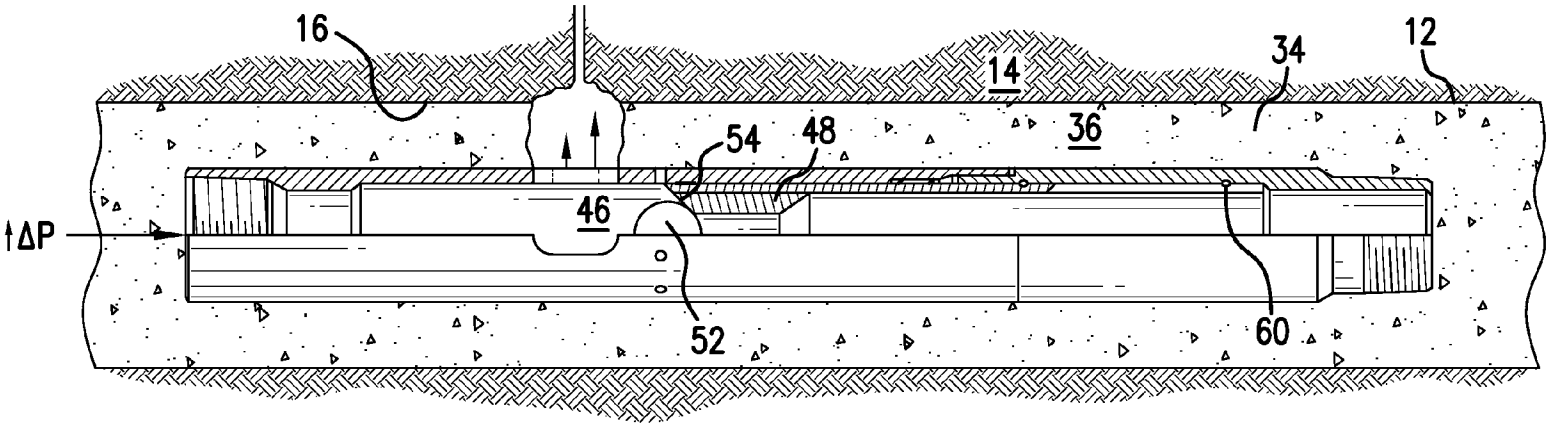
FIG. 6 is a partial quarter cross-sectional view of the downhole system of FIG. 1 with the radially extendable member removed and a fracture procedure initiated; and, FIG. 7 is a partial quarter cross-sectional view of another exemplary embodiment of a downhole system with a radially extendable member in a non-extended condition.

Once the cement 34 has cured and the member 38 removed, the result is a substantially cemented completion system 10 with a cement sheath that is absent or severely compromised in the areas adjacent to any of the flow ports 22 as a result of the foam deployment. Removal of the members 38 result in large sections of exposed formation 14 ideal for stimulation. As shown in FIG. 6, once the agent 50 has degraded the member 38 in the area exposed by the displaced sleeve 48, pump rate can increase and the first fracture stage can be completed. The ports 22 can be divided up into one or more zones, with just a single one of the zones being illustrated herein and the sliding sleeves 48 prevent simultaneous pressuring up of all zones located along the system 10. Subsequent stages can be completed by dropping the appropriate ball size and landing the ball 52 while pumping more of the agent 50 for attacking the shape memory polymer foam, substantially increasing the area available to flow through the ports 22. The fracture treatment will follow, and the pattern will continue until all sleeves 48 are opened. In this manner all of the stages in the system 10 benefit from the large flow area unfettered by tortuous perforation tunnels or cement, yet most of the completion is cemented in place, maximizing wellbore integrity.

Removal of the member 38 allows fluidic communication between an interior 46 of the tubular 18 and the earth formation 14. This fluid communication allows treating of the formation 14. Such treatments include fracturing, pumping proppant and acid treating, for example. Additionally, the system 10 would allow for production of fluids, such as hydrocarbons, for example, from the formation 14. The system 10 enables the use of pre-formed ports 22 within the tubular 18, as opposed to perforating the tubular 18 with perforations while within the borehole 12.

Figure 7:
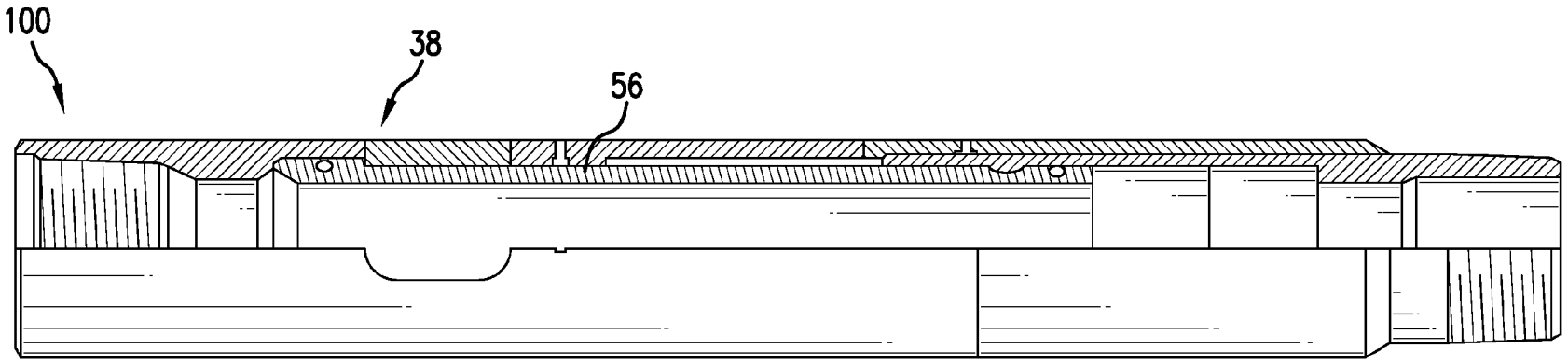

While FIGS. 1-6 depict the downhole system 10 in conjunction with a ball-activated sleeve 48, it should be understood that the system is also usable with other types of frac sleeves 56, such as, but not limited to, pressure actuated sleeves, hydraulically actuated sleeves, electrically actuated sleeves, and sleeves operable by downhole tools such as wireline devices, shifting tools, and bottom hole assemblies. An exemplary sleeve 56 not actuated by a ball 52 is shown in FIG. 7 with the member 38 in a compressed condition. With the exception of the sleeve 56 being movable by a means other than the ball 52, the system 100 shown in FIG. 7 may be operated in a manner similar to the system 10 shown in FIGS. 1-6. Other arrangements for blocking the fluid communication between the interior 46 of the tubular 18 and the annular space 36, as well as alternate arrangements for zonal isolation are also within the scope of the arrangements and the sleeves 48, 56, and ball and ball seats 52, 54 are described for exemplary purposes.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole system comprising:

a tubular having a wall with at least one port there through;

at least one member arranged to cover the at least one port in a compressed condition thereof, and configured to at least partially displace cement pumped on an exterior of the tubular in a radially expanded condition of the at least one member; and, at least one sleeve engaged within the tubular and movable between a first position preventing fluid communication between an interior of the tubular and the at least one port during radial expansion of the at least one member, to a second position to expose the at least one member to the interior of the tubular after the cement has at least substantially cured;

wherein the at least one member degrades a strength of cured cement in an area occupied by the at least one member.

2. The downhole system of claim 1, wherein the at least one member is foam.

3. The downhole system of claim 2, wherein the foam is a shape memory polymer foam.

4. The downhole system of claim 2, wherein at least some cement is partially entrapped by pores in the at least one member in the radially expanded condition.

5. The downhole system of claim 1, wherein the at least one member is expandable upon exposure to heat.

6. The downhole system of claim 1, wherein the at least one member is configured to expand upon contact with curing cement.

7. The downhole system of claim 1, wherein the system is runnable within a borehole in a formation, and further comprising cement positionable within an annular space between the tubular and the borehole, and the at least one member is configured to expand radially outwardly into the annular space and towards walls of the borehole upon radial expansion.

8. The downhole system of claim 1, wherein the at least one member is at least partially contained within the at least one port in the compressed condition of the at least one member.

9. The downhole system of claim 1, wherein the at least one member covers more than one port among the at least one port in the tubular.

10. The downhole system of claim 1, wherein the at least one port extends from an inner diameter to an outer diameter of the wall.

11. The downhole system of claim 1 further comprising a cement sheath surrounding the wall of the tubular, the cement sheath including the cement displaced during radial expansion of the at least one member, wherein, in a substantially cured condition of the cement, the at least one member is degraded to at least partially expose a portion of the borehole wall and provide fluidic communication between the at least one port and the borehole wall through the cement sheath.

12. A downhole system comprising:

a tubular having a wall with at least one port there through;

at least one member arranged to cover the at least one port in a compressed condition thereof, and configured to at least partially displace cement pumped on an exterior of the tubular in a radially expanded condition of the at least one member, wherein the at least one member is foam; and a foam attacking agent passable through the tubular and to the at least one member when the at least one member is in an expanded condition, wherein introduction of the foam attacking agent provides a pathway from the port to a borehole wall.

13. The downhole system of claim 12, wherein the foam attacking agent is a solvent including dimethylformamide or ethylene glycol monobutyl ether.

14. A method of non-ballistically opening ports in a tubular of a downhole system, the method comprising:

covering at least one port in the tubular with an initially compressed radially extendable member;

blocking the at least one port with a movable sleeve within the tubular;

inserting the tubular within a borehole;

cementing an annular space between the tubular and the borehole;

allowing the radially extendable member to expand from heat of curing cement;

at least partially displacing the cement with the radially extendable member; and, after the cement is at least substantially cured, moving the movable sleeve to expose the radially extendable member to an interior of the tubular.

15. The method of claim 14, wherein covering at least one port in the tubular with an initially compressed radially extendable member includes covering at least one port in the tubular with an initially compressed radially extendable shape memory polymer foam member.

16. The method of claim 15, further comprising introducing a foam attacking agent in the tubular and out the port to at least partially dissolve the foam member.

17. The method of claim 16, wherein the foam attacking agent is dimethylformamide or ethylene glycol monobutyl ether.

18. The method of claim 16, further comprising performing a stimulation operation through the port and at least partially dissolved foam member.

* * * * *